US005787668A

United States Patent [19]

Carkner et al.

[11] Patent Number: 5,787,668

[45] Date of Patent: Aug. 4, 1998

[54] VENTILATED INSULATED ROOFING SYSTEM WITH IMPROVED RESISTANCE TO WIND UPLIFT

[75] Inventors: Philip M. Carkner, Grapevine, Tex.; Todd L. Corley, Bismarck, Ark.; Hubert T. Dudley, Chelmsford, Mass.; Timothy L. Kersey, Arkadelphia, Ark.

[73] Assignee: Siplast, Inc., Irving, Tex.

[21] Appl. No.: 613,309

[22] Filed: Mar. 11, 1996

[51] Int. Cl.[6] ..... E04B 1/16

[52] U.S. Cl. ..... 52/408; 52/310; 52/309.12; 52/783.1; 52/783.19; 52/302.1

[58] Field of Search ..... 52/309.12, 408, 52/783.1, 783.19, 783.11, 378, 310, 302.1

[56] References Cited

U.S. PATENT DOCUMENTS

| | | | |
|---|---|---|---|
| 2,879,662 | 3/1959 | Spinelli | 52/310 X |
| 3,619,961 | 11/1971 | Sterrett et al. . | |
| 3,868,296 | 2/1975 | McKeon, Jr. et al. . | |
| 3,961,841 | 6/1976 | Carroll | 52/309.12 |
| 4,021,981 | 5/1977 | Van Wagoner | 52/408 X |
| 4,044,520 | 8/1977 | Barrows . | |
| 4,120,131 | 10/1978 | Carroll . | |
| 4,189,886 | 2/1980 | Frohlich et al. | 52/310 X |
| 4,449,336 | 5/1984 | Kelly | 52/408 X |
| 4,454,702 | 6/1984 | Bonilla-Lugo et al. . | |
| 4,655,014 | 4/1987 | Krecke . | |
| 4,658,554 | 4/1987 | Riley et al. | 52/408 X |
| 4,747,247 | 5/1988 | Petersen, Jr. et al. | 52/408 |
| 4,841,702 | 6/1989 | Huettemann . | |
| 4,882,888 | 11/1989 | Moore | 52/408 X |
| 4,937,990 | 7/1990 | Paquette | 52/408 X |
| 4,977,711 | 12/1990 | Prignitz . | |
| 5,095,674 | 3/1992 | Huettemann . | |
| 5,332,602 | 7/1994 | Barré et al. | 52/783.1 X |
| 5,351,454 | 10/1994 | Hahne et al. . | |

*Primary Examiner*—Wynn E. Wood

*Attorney, Agent, or Firm*—Charles W. Hanor, P.C.; Kirt S. O'Neill, Esq.

[57] ABSTRACT

A composite roofing system in which a layer of polystyrene or polyurethane foam insulation board is encased in layers of lightweight insulating concrete and the surface of the foam insulation board is roughened to strengthen the interfacial bond with the surrounding layers of concrete and provide increased resistance to wind uplift, seismic activity, and degradation of the roofing system caused by vertical loads. Moisture which might otherwise become entrapped in the roofing system by the impermeable insulation board is ventilated out of the system by a combination of openings through the insulation board which permit the migration of moisture between the layers of concrete, and a plurality of lateral slots cut in the insulation board to permit further migration of moisture out of the system. Surface roughening of the foam insulation board is accomplished by forming a plurality of typically conical recesses in one or both surfaces of the insulation board which then become filled with concrete when the system is built up using fluid concrete at the construction site. The recesses are formed in the insulation board with a single cylindrical roller with protrusions on the surface thereof, or both surfaces of the insulation board may be simultaneously treated with a dual opposed roller configuration. After filling and setting in the recesses, the insulating concrete enhances the interfacial bond, increasing resistance to both transverse forces caused by wind uplift and horizontal shear forces caused by downward loading on the roof system or by seismic activity.

24 Claims, 3 Drawing Sheets

VENTILATED INSULATED ROOFING SYSTEM WITH IMPROVED RESISTANCE TO WIND UPLIFT

BACKGROUND OF THE INVENTION

The invention relates to improved ventilated, insulated roofing systems which may be formed, or built up, at the construction site. More particularly, the invention relates to a construction of such a system which provides improved resistance to a phenomenon known as wind uplift, and which offers increased resistance to downward load and horizontal shear forces, by strengthening and enhancing the interfacial bond between an insulating layer and its adjacent structural layers.

Insulated roofing constructions comprising a thermal insulating layer interposed between structural layers made of concrete or metal are commonly used to provide a structurally sound roof with insulating capabilities, especially where such systems are assembled or "built up" at the job site. Typically, these constructions include insulation boards made of low-permeance, cellular synthetic resinous material such as foamed or expanded polystyrene or polyurethane. The insulation boards are commonly positioned between layers of moisture-bearing, lightweight insulating concrete, which offers both thermal insulating capability and structural rigidity. The insulating concretes are generally mixtures of Portland cement, water and a lightweight aggregate such as expanded vermiculite, perlite, or fly ash. They can also be mixtures of Portland cement, water and pregenerated foam—mixtures known to those skilled in the art as "cellular concrete." The use of such insulating concrete layers offers the advantage that the roofing system can be built up at the job site, where a first layer of concrete can be prepared and spread on a structural base, followed by the placement of adjacent insulation boards transported to the job site, and then by the application of a second layer of concrete over the insulation boards. Such a system is shown in U.S. Pat. No. 3,619,961 to Sterrett et al. On top of these layers of foam insulation and concrete, a waterproofing layer of felt or bitumen is typically applied to complete the roof construction.

It is also known to employ a network of holes, voids, or slots in the insulation boards of such systems to permit the passage of moisture between the layers of concrete, which are characterized by significant water permeability. The water-to-cement ratio for such lightweight insulating concrete is typically several times that of conventional structural cement. This excess mix water is employed to render the material sufficiently fluid for placement. However, it is uneconomical to delay final construction and application of the felt or bituminous layer until the lightweight concrete aggregate has completely cured and dried out. Construction of the roofing system is therefore often completed before the layers of concrete are completely dried. But if construction of the roof assembly is completed before the concrete has fully dried and cured, air and moisture can easily become trapped beneath the waterproofing layer by the low-permeance layer of foam insulation. An attendant disadvantage is that pockets of air trapped between the concrete slurry and the foam insulation board decreases the strength of the interfacial bond formed between the two layers as the concrete dries. It is therefore desirable to provide a means to vent both excess air and moisture during the drying and curing process.

In addition, external sources of moisture, such as humidity or rain from the atmosphere, may also cause the build-up of moisture beneath the waterproofing layer. Such moisture can similarly be trapped by the low-permeance insulating foam. Moisture vapor from all of the aforementioned sources can cause the formation of bubbles and subsequent leaks in the bituminous waterproofing layer, especially on hot days when the water vapor is caused to expand from the heat. In the Sterrett et al. patent, the problem of venting such entrapped moisture is partially solved by forming slots in a number of the lateral surfaces of the plastic foam insulation board which act to convey moisture around the board and eventually outside the roofing system. Slots of the type disclosed by Sterrett et al. also serve to ventilate excess air trapped between the concrete slurry and the foam insulation board upon placement of the insulation board.

Another solution is provided by U.S. Pat. No. 3,884,009 to Frohlich et al., in which the foam insulation board is provided with a plurality of holes which permit passage of moisture away from the uppermost layer of concrete. The moisture can eventually be conveyed out of the system through slots formed in the lowermost layer of the roofing system, which is typically made of metal. In the Frohlich et al. '009 patent, the holes or voids are sized sufficiently small to permit the passage therethrough of moisture while simultaneously inhibiting the filling of the holes or voids by the uppermost layer of concrete, which is applied in a fluid state over the foam insulation board at the job site.

The use of a network of such holes or voids to simultaneously provide for the venting of air and moisture out of the system and for increased structural stability of the system is also known. Other previous systems make use of relatively large holes or voids in the foam insulation layer, thereby allowing the fluid concrete from the upper layer to flow into and fill up the openings. In such a system, the "bridges" of concrete formed in the foam layer serve chiefly to key the upper layer of concrete to the lower layer, thereby enhancing the structural rigidity of the system. At the same time, the moisture permeability of the concrete, including the concrete "bridges" formed in the holes or voids of the foam insulating layer, permits the transmittance of moisture from the uppermost layer of concrete to the lowermost layer. Such moisture transmittance, however, is relatively less than that of the smaller open holes or voids shown in the Frohlich et al. '009 patent. The particular advantages of both relatively large and relatively small holes or voids can be obtained together by making limited use of holes or voids of both sizes, as disclosed and claimed in U.S. Pat. No. 4,189,886 to Frohlich et al.

All of the foregoing constructions suffer from the disadvantage that the interfacial bonds between the layers of concrete and the foam insulating layer may not be as strong as desired, subjecting the roofing system to failure due to a phenomenon known as "wind uplift." According to this phenomenon, the lateral movement of air (wind) over the top surface of the roofing system causes a reduction in air pressure above the roof, not unlike the air pressure reduction which occurs over an airplane wing in flight. The reduced air pressure above the roofing system imparts forces parallel to the plane of the roofing system, resulting in "uplift" of the roof assembly. These forces tend to pull apart the various layers of the composite roofing systems described above, thereby inducing failure of the roofing system.

Wind, downward load, seismic activity and other phenomena may also impart lateral forces along the face of the top layer of the roofing system, and these lateral forces are often transmitted to the lower insulating layers. Such lateral forces, also designated as horizontal shear forces, may contribute to wind uplift failure, particularly when acting in conjunction with transverse forces associated with wind uplift. They may also decrease the downward load capacity of the roofing system. Because of their susceptibility to this type of failure, such composite roofing systems may fail to meet increasingly stringent building codes, insurance requirements, and other regulatory requirements, particularly in geographic regions where strong winds are common.

Ventilated insulated roofing systems such as those shown in Sterrett et al., Frohlich et al. '009, and Frohlich et al. '886 are susceptible to the effects of wind uplift in part because the relatively smooth surfaces of the foam insulating layer do not form a particularly strong interfacial bond with the surrounding layers of lightweight concrete. And although "bridging" the lightweight concrete layers through holes or voids in the foam insulating layer, as in the Sterreft et al. patent, increases the resistance to separation of the various layers of a composite roofing system, such "bridging" techniques suffer from inherent disadvantages. For example, "bridging" reduces the insulating capabilities of the overall system, since any increase in the number or size of the holes or voids necessarily results in an increase of thermal transfer through the foam insulating layer. What is needed is a ventilated insulated roofing system having an increased resistance to wind uplift and lateral shear forces without the attendant disadvantages of excessive "bridging."

SUMMARY OF THE INVENTION

The present invention is directed to a ventilated insulated roofing system wherein the interfacial bond between one or more insulating layers is strengthened against the operation of forces caused by wind uplift, downward load, and seismic activity. In the invention, the roofing system is formed by successive application of one or more base layers of metal or lightweight concrete, or both; a layer of low-permeance, cellular insulation board, such as polystyrene foam; an upper layer of lightweight concrete; and a waterproofing layer of felt, bituminous material, or a combination thereof. The foam insulating layer is formed by a plurality of panel sections laid end to end over a lowermost layer of lightweight concrete, which may in turn be applied over a concrete or metallic decking substrate. The lightweight concrete for the lowermost and uppermost concrete layers is mixed and poured at the construction site and allowed to harden in place. The resulting structure is both relatively lightweight and thermally insulating. Such a system results in lower-cost construction, since casting molds and the transportation of concrete panels or sections to the construction site are eliminated.

The upper and lower layers of lightweight concrete are vented of moisture by a plurality of holes or voids formed in the foam insulating layer, which permit moisture to migrate through the low-permeance insulation board. Moisture is also conveyed out of the system through a plurality of transverse slots formed in the foam insulating layer. Either alternatively to such slots or in addition thereto, moisture may also be allowed to pass out of the system through a plurality of slots formed in the metallic base layer if such a layer is employed.

The interfacial bond between each surface of the foam insulating layer and its respective adjoining surface of lightweight concrete is strengthened and enhanced by the formation of a plurality of recesses in the surfaces of the foam insulating layer. These recesses may be of any shape, but are preferably conical. These recesses do not extend through the foam insulating layer, but rather they serve to increase the surface area of the interface. Fluid concrete on each side of the foam insulating layer fills these recesses and hardens. The overall roughening and increased interfacial surface area provided by this surface treatment enhances the interfacial bond at each surface of the foam insulating layer. In addition, the interlocking of these recesses and the concrete protrusions filling the recesses offers increased resistance to horizontal shear in the roofing system, providing increased downward load capacity and increased resistance to wind uplift. At the same time, thermal loss associated with conventional "bridging" of the concrete layers through holes or voids in the foam insulation is avoided.

The plurality of recesses, regardless of their shape, are formed on-site or off-site, preferably by a simple, dual opposed roller mechanism through which each foam insulating board is passed. Screws or conical-shaped protrusions on the face of each roller form the recesses on the surfaces of the foam insulating board as the rollers turn. Alternatively, if it is desired to treat only one face of the foam insulating board, a single roller may be used. The dual or single roller may be transported to the construction site for on-site treatment of the insulating boards, but preferably such surface treatment is done by the manufacturer off-site. Surface roughening may also be accomplished by a simpler hand implement capable of forming only one or a few recesses in the foam insulating board at a time.

In the invention, a plurality of holes or voids are also formed in the foam insulating layer to provide a path for migration of moisture through the foam insulating layer. These holes or voids may be of sufficient diameter to permit the "bridging" of upper and lower layers of lightweight concrete when fluid concrete from the upper layer fills the holes or voids to form a bond with the lower concrete layer. Lateral slots are also formed in the foam insulating layer to provide for the efficient movement of moisture out of the system.

It is therefore an overall object of the present invention to provide a ventilated insulated roofing system with an increased resistance to wind uplift.

It is a further object of the present invention to provide a ventilated insulated roofing system with an increased load carrying capacity and seismic resistance.

It is a further object of the present invention to provide a ventilated insulated roofing system with an increased resistance to wind uplift, but without the loss in thermal insulating capability introduced by excessive "bridging" of concrete layers.

It is a further object of the present invention to provide a ventilated insulated roofing system having an enhanced interfacial bond between one or more surfaces of a foam insulating layer and an adjacent surface of a lightweight concrete layer.

It is a further object of the present invention to provide a ventilated insulated roofing system with an increased resistance to uplift and seismic and an increased load carrying capacity, which system can be assembled or prepared at the construction site.

It is a further object of the present invention to provide a ventilated insulated roofing system wherein structural components contributing to an increased loady carrying capacity and an increased resistance to wind uplift and seismic activity are formed at the construction site.

BRIEF DESCRIPTION OF THE DRAWINGS

The invention will be more clearly understood after reference to the following detailed specification read in conjunction with the drawings, wherein.

DETAILED DESCRIPTION OF THE PREFERRED EMBODIMENT

Figure 1:
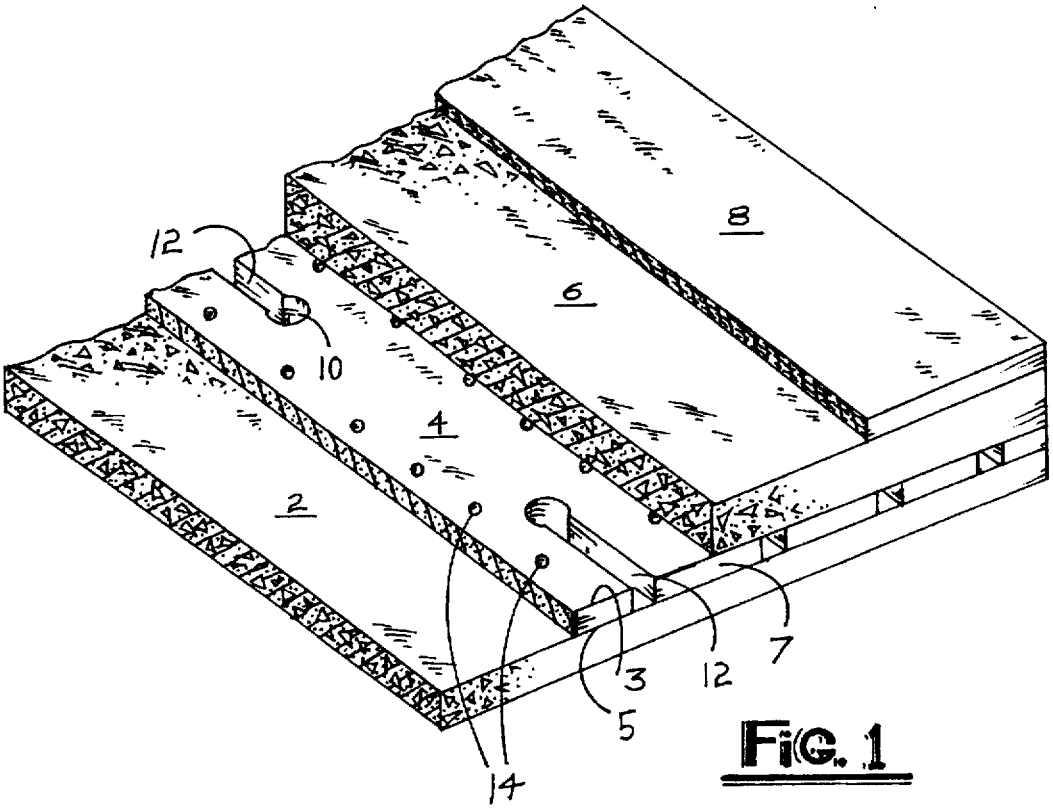
FIGS. 1–2 are perspective views, partially in section, of roofing installations according to various embodiments of the invention.

Referring now to the figures, FIG. 1 shows in partial cross-section the various layers of a built-up composite roofing system. A first layer 2 of lightweight insulating concrete material is applied in a fluid state over any available substrate material, which is usually metal or pre-existing concrete. Prior to drying of the first layer 2 of concrete, a layer comprising foam insulation boards 4 is applied adjacent to and over the first layer of lightweight concrete. Each insulation board 4 is of a length and width convenient for the manufacture and transportation of the boards. A complete layer of foam insulation boards is typically formed of hundreds of individual insulation boards 4, and the exact number will depend on many factors, including the size of each board and the size of the roof to be constructed.

After placement of the layer of foam insulation boards 4, a second layer 6 of lightweight insulating concrete is applied over the layer of foam insulation boards. A plurality of large openings or holes 10 formed through each insulation board 4 receive partially liquid concrete from uncured first layer 2 and second layer 6. As described with reference to FIG. 3 below, the large openings 10 are preferably sized to be of sufficient diameter to become substantially filled with concrete from first layer 2 and second layer 6. Upon drying, this concrete forms "bridges" between the two layers, thereby keying the first and second layers of concrete to each other. Transverse slots 12 are also formed in each insulation board 4 so as to connect each of the large openings 10 with an edge 7 of the foam insulation board. These transverse slots 12 permit the further migration of moisture out of the roofing system. After application of the second layer 6 of insulating concrete, a waterproofing layer 8, usually felt or bituminous material, is applied to complete the roofing system.

Each foam insulation board 4 has an upper surface 3 and a lower surface 5 and edges 7 (one of which is shown). Preferably, each upper surface 3 and lower surface 5 of the insulation board is formed with a plurality of recesses or indentations 14. These recesses preferably do not penetrate through the insulation board 4, but are of sufficient diameter and depth that they are substantially filled with liquid concrete from first layer 2 and second layer 6 during construction of the roofing system to bind adjacent layers together. These recesses 14 are relatively small in diameter compared to the large openings 10, and there are preferably many more recesses 14 than large openings 10. These recesses can therefore be seen to constitute a surface "roughening" of the foam insulation board 4. The greater the number and depth of the recesses 14, the greater will be the strengthening of the interfacial bond between the foam insulation board 4 and the first layer 2 and second layer 6 of insulating concrete. Because the recesses 14 do not penetrate completely through the insulation board 4, relatively many recesses can be accommodated without significantly impairing the insulating capacity of the insulation board. In contrast, each large opening or hole 10 represents a breach of the thermal barrier presented by the insulation board 4, and thus relatively fewer large openings can be efficiently accommodated to provide an interlocking effect.

It will be understood that, although maximum resistance to wind uplift is accomplished by roughening both the upper surface 3 and the lower surface 5 of each foam insulation board, improvements may still be realized with less surface roughening. For example, roughening only the upper surface 3 of the foam insulation may still provide acceptable results. Alternatively, only the lower surface 5 may be roughened. In addition, it may be acceptable to roughen either one or both surfaces of some insulation boards 4 in the roofing system, without roughening the surfaces of other insulation boards.

Figure 2:
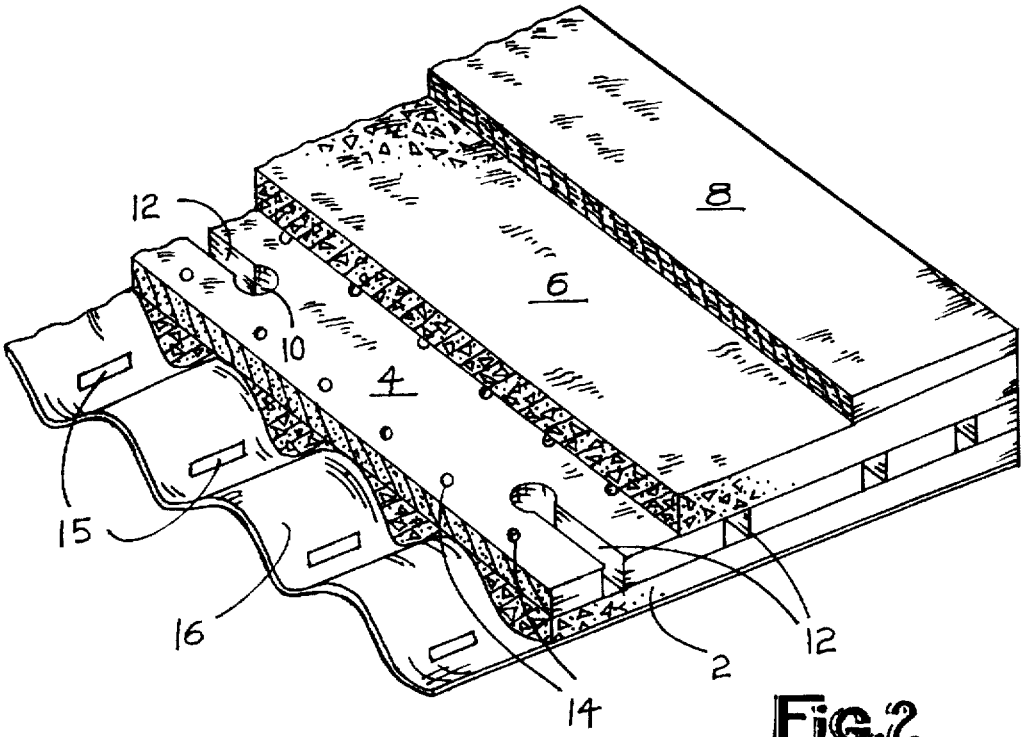

FIG. 2 shows in partial cross-section a composite roofing system of the type described, and more particularly a roofing system provided with a base metallic layer 16. Where a composite roofing system is to be constructed on top of an existing roofing base, that base is typically pre-existing concrete, and the flat construction of FIG. 1 is most suitable. For new roof constructions, there is preferably provided a base metallic layer 16 over which the first layer 2 of insulating concrete is poured. The base metallic layer is preferably corrugated, and may have a plurality of slots 15 formed longitudinally therethrough to permit moisture from the first layer 2 of insulating concrete to pass downward out of the system.

Figure 3:
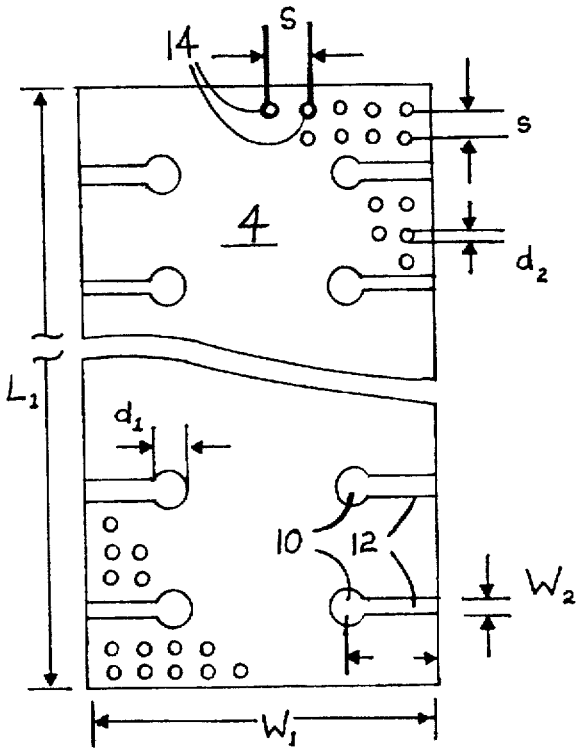
FIG. 3 is a plan view of a foam insulating board with surface roughening, holes for bridging upper and lower layers of concrete, and lateral slots for the migration of moisture out of the system.

Referring now to FIG. 3, there is shown a single foam insulation board 4 having a plurality of large openings 10, transverse slots 12, and recesses 14 formed therein. The insulation board typically has a length $L_1$ of 48 inches and a width $W_1$ of 24 inches. The insulation board 4 is typically made of low-permeance, cellular synthetic resinous material such as foamed or expanded polystyrene or polyurethane. The thickness of the insulation board will vary depending on the particular insulation requirements of the overall system, but thicknesses ranging from about one inch to about 16 inches are known to be effective. In the preferred embodiment, there is provided a plurality of large openings 10, each connected to an edge of the insulation board by a transverse slot 12. The largest cross-wise dimension $d_1$ (diameter, where the openings are circular in cross-section) of the large openings 10 is sufficiently large to permit concrete from first layer 2 and second layer 6 to substantially fill the large openings, thereby bridging the two layers. For this purpose, diameters on the order of 1⅜ inches have been used. Transverse slots 12 have a width $W_2$ which is small enough to prevent filling thereof by concrete, but large enough to permit the efficient migration of moisture along the channel and out of the system. For this purpose, widths on the order of 3/16 inch have been used. The length $L_2$ of the transverse slots 12 depends primarily on the number of large openings to be provided in each insulation board 4, and may be about six inches.

The recesses 14 in FIG. 3 are sized, shaped, and spaced apart to provide the desired degree of surface roughening and interfacial bond strength. The recesses 14 may be conical in shape, with a largest cross-wise dimension $d_2$ of about ¼ inch and a nominal depth of about ½ inch in the preferred embodiment. Typically, the largest cross-wise dimension of the recesses 14 will not exceed ½ inch, although larger dimensions may be employed. In actuality, the particular size and shape of the recesses will usually be governed by the available tools for forming the recesses, as well as the type of materials used. For example, cylindrical recesses may be used where small rods are available for forming the recesses. But it will be apparent that the recesses need not have a circular cross-section, as with a cone or a cylinder. However, the largest cross-wise dimension of the recesses should at least be sufficient to permit substantial filling of the recesses by the liquid concrete. Spacing between recesses 14, too, is a function of the desired degree of surface roughening. In the preferred embodiment, this spacing S between nearest-neighbor recesses 14 may be about 1½ inches. Such close spacing provides a significantly strengthened interfacial bond between the foam insulation board 4 and the first layer 2 and second layer 6 of insulating concrete.

Figure 4:
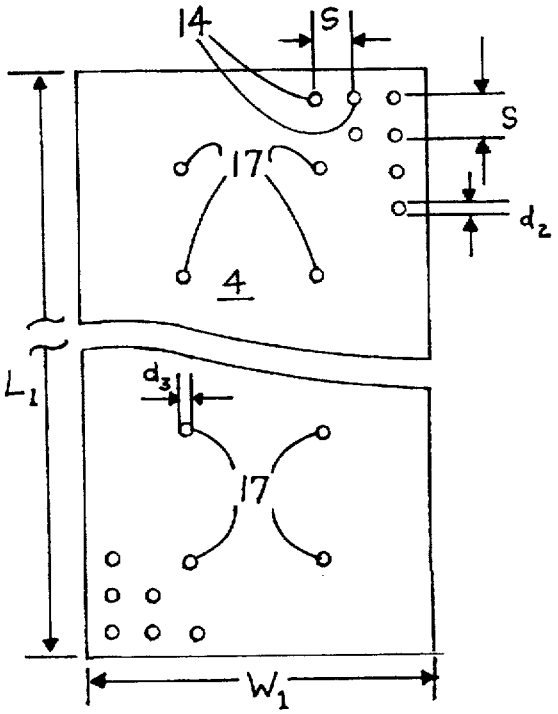
FIG. 4 is a plan view of an alternative embodiment of a foam insulating board, with smaller holes and no lateral slots.

FIG. 4 shows an alternative embodiment of a foam insulation board for use in a multi-layer insulated roofing system. In place of large openings, there are provided through the insulation board 4 a plurality of relatively small openings or holes 17 of sufficient cross-wise dimension $d_3$ to permit the passage of moisture therethrough, while simultaneously being small enough to prevent the filling of the small openings 17 by concrete from the first layer 2 or second layer 6. A largest cross-wise dimension $d_3$ which is on the order of about ⅛ to 3/16 inch has provided satisfactory results. The precise dimension $d_3$ will be a function both of the thickness of the insulation board 4 and the fluidity of the insulating concrete of first layer 2 and second layer 6. These small openings have the advantage of providing moisture permeability without the thermal loss which occurs with the use of relatively large openings. It will be readily understood that any combination of large openings 10, small openings 17, transverse slots 12 and recesses 14 can be employed to achieve the desired insulation, ventilation, and interfacial bonding characteristics.

Figure 5:
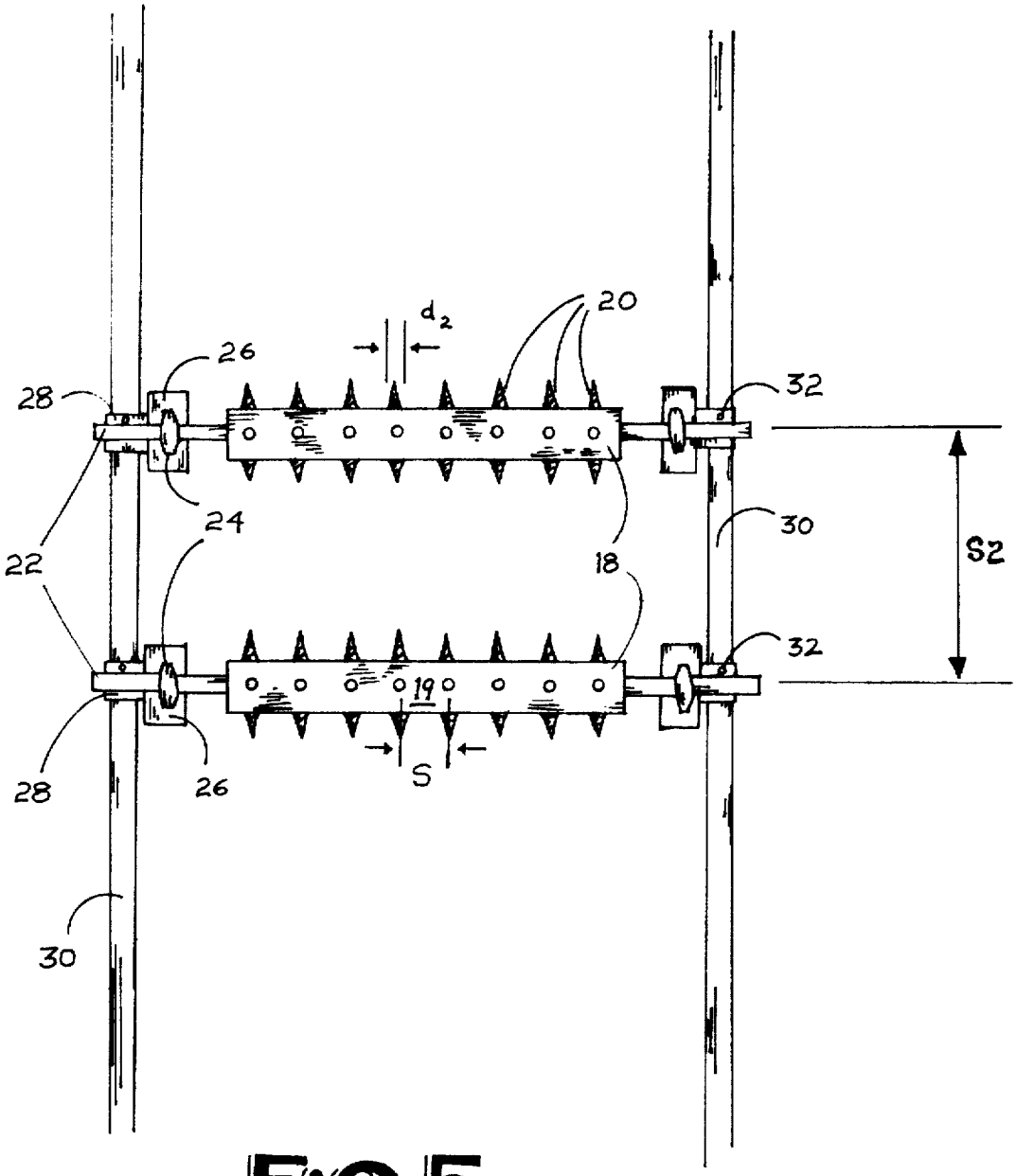
FIG. 5 is a side view of a dual opposed roller for roughening both surfaces of a foam insulating board by forming a plurality of recesses in the both board surfaces.

FIG. 5 shows a dual opposed roller assembly for forming the recesses 14 in both surfaces of the foam insulation board 4. Curved surfaces 18 of dual opposed cylindrical rollers 19 have a plurality of protrusions or punches 20 extending therefrom. Each insulation board with surfaces to be roughened is passed lengthwise between dual opposed rollers 19 to roughen the surfaces of the insulation board. The protrusions 20 are sized and shaped to produce the desired size and shape of recesses 14 in the insulation board. Preferably, the protrusions or punches 20 are threaded wood screws or sheet metal screws, which produce conical-shaped recesses and efficiently displace polystyrene or polyurethane foam from the recesses of the insulation board. However, other protrusions may be used, such as nails or small rods. Regardless of the type of protrusion or punch selected, each protrusion or punch is typically inserted through holes from within the cylindrical surface 18 of the roller 19, and rigidly mounted to the roller.

Each roller 19 is preferably mounted on an axle 22 which turns freely at either end in bearing assemblies 24 as the insulation board 4 is passed between the rollers. If the thickness of insulation boards to be roughened is not to be varied so that the distance $s_2$ between axles is constant, the bearing assemblies may be fixedly mounted to a rigid structure. However, it is preferable to be able to vary the distance $s_2$ in accordance with the particular thickness of insulation board to be treated, and this thickness may vary significantly from one roofing assembly to another. Accordingly, a variable-spacing mechanism such as that shown in FIG. 5 may be provided. In such a mechanism, each bearing assembly 24 is mounted on a collar plate 26, which forms a rigid extension of sliding collar 28. Each sliding collar 28 is slidably mounted on a vertical spacing bar 30, and the vertical position of each roller 19 may be temporarily fixed by tightening the collar lock 32 on each sliding collar 28. The collar lock 32 is typically a simple bolt which turns in a threaded opening in sliding collar 28, tightening against spacing bar 30 as the bolt advances.

The variable spacing mechanism just described permits the surface roughening of insulation board of any desired thickness. It also permits rollers of a given spacing $s_2$ to be raised or lowered in tandem so that the insulation board may be passed between the rollers at a desired height, which allows the worker treating the insulation boards to select the height at which he wishes to work.

A further advantage of this system is that the surface roughening assembly is small and compact enough that it can easily be transported to the construction site where the roof is to be built up. Although it is anticipated that most surface roughening will be performed off-site, such as in a factory where large volumes of insulation board can be treated, on-site surface roughening offers several advantages. For example, it may be determined at the construction site that only a portion of the insulation boards to be used in the roofing system need to be roughened. Alternatively, it may be determined at the construction site that the size, shape, or spacing of the recesses should be different than that which might have been used at the factory.

If it is desired to roughen only one surface of each insulation board 4, a single roller 19 with protrusions or punches may be employed instead of the dual opposed roller configuration of FIG. 5. A single roller 19 can easily be applied to an insulation board placed flat on a supportive surface. In such a configuration, the bearing assemblies 24 of a single roller 19 may be joined by rods or other rigid connections to a handle suitable for manipulation by a worker desiring to roll the roller 19 over the insulation board 4.

While a particular embodiment of the invention has been illustrated and described, it will be obvious to those skilled in the art that various changes and modifications may be made without sacrificing the advantages provided by the principle of construction disclosed herein.

Having described our invention, we claim:

1. A ventilated, insulated roof comprising:

a first layer of lightweight insulating concrete;

a layer adjacent to said first layer and comprising a plurality of normally low-permeance insulation boards having upper and lower surfaces, at least one of said boards having:

(a) a plurality of recesses formed in at least one of said upper and lower surfaces and extending only partially therethrough; and (b) a plurality of openings therethrough for the passage of moisture;

a second layer of lightweight insulating concrete adjacent to and above said insulation boards;

said recesses being substantially filled by lightweight insulating concrete to bond the layers together, thereby increasing the load carrying capacity of the insulated roof and enhancing the insulated roofs resistance to wind uplift and seismic activity.

2. The ventilated, insulated roof of claim 1 wherein said recesses are substantially conical in shape.

3. The ventilated, insulated roof of claim 1 wherein said recesses are substantially cylindrical in shape.

4. The ventilated, insulated roof of claim 1 wherein said recesses have a largest cross-wise dimension not greater than one-half inch.

5. The ventilated, insulated roof of claim 1 wherein said plurality of recesses are spaced no farther apart than one and one-half inches.

6. The ventilated, insulated roof of claim 1 wherein said recesses are formed by protrusions from the curved surface of a cylinder.

7. A ventilated, insulated roof comprising:

a base metallic layer;

a first layer of insulating concrete adjacent to and above said base metallic layer;

a layer adjacent to said first layer and comprising a plurality of insulation boards, said insulation boards having upper and lower surfaces;

at least one of said boards having a plurality of recesses formed in at least one of said upper and lower surfaces and extending only partially therethrough;

at least one of said boards having a plurality of openings therethrough for the passage of moisture;

a second layer of insulating concrete adjacent to and above said insulation boards; said recesses being substantially filled by insulating concrete to bond the layers together, thereby increasing the load carrying capacity of the insulated roof and enhancing the insulated roof's resistance to wind uplift and seismic activity.

8. The ventilated, insulated roof of claim 7 wherein said base metallic layer is corrugated.

9. The ventilated, insulated roof of claim 7 wherein said insulation boards are made at least in part from a material selected from the group consisting of polystyrene and polyurethane.

10. The ventilated, insulated roof of claim 9 wherein at least some of said openings are of sufficient cross-wise dimension that concrete from said second layer of insulating concrete will flow into and substantially fill them and thus provide bridges of insulating concrete to be formed through said insulating board.

11. The ventilated, insulated roof of claim 10 wherein at least some of said openings are of such dimension that passage of moisture is permitted yet substantial filling of the openings by fluid concrete placed thereon is prevented.

12. The ventilated, insulated roof of claim 10 wherein at least one of said openings of sufficient cross-wise dimension is connected to an edge of said insulating board by a transverse slot formed through the insulating board and extending from the opening to the edge of the insulating board.

13. The ventilated, insulated roof of claim 7 wherein said recesses are formed by protrusions from the curved surface of a cylinder.

14. A ventilated, insulated roof comprising:

a base metallic layer;

a first layer of lightweight insulating concrete adjacent to and above said base metallic layer;

a layer adjacent to said first layer and comprising a plurality of insulation boards, said insulation boards having upper and lower surfaces;

at least one of said boards having a plurality of recesses formed in at least one of said upper and lower surfaces and extending only partially therethrough, said recesses have a largest cross-wise dimension not greater than one-half inch;

at least one of said boards having a plurality of openings therethrough for the passage of moisture, at least some of said openings being of sufficient cross-wise dimension that concrete from said second layer of insulating concrete will flow into and substantially fill them and thus provide bridges of said insulating concrete to be formed through said insulating board;

at least one of said openings of sufficient cross-wise dimension being connected to an edge of said insulating board by a transverse slot formed through said insulating board and extending from said opening to said edge of said insulating board;

a second layer of lightweight insulating concrete adjacent to and above said insulation boards;

said recesses being substantially filled by lightweight insulating concrete to bond the layers together, thereby increasing the load carrying capacity of the insulated roof and enhancing the insulated roofs resistance to wind uplift and seismic activity.

15. The ventilated, insulated roof of claim 14 wherein said recesses are formed by protrusions from the curved surface of a cylinder.

16. A method of constructing a ventilated, insulated roof comprising the steps of:

applying a first layer of lightweight insulating concrete;

applying an insulating layer over said first layer, said insulating layer comprising a plurality of normally low-permeance insulation boards having up and lower surfaces, at least one of said boards having:

(a) a plurality of recesses formed in at least one of said upper and lower surfaces and extending only partially therethrough, said recesses being dimensioned so as to be substantially filled by said lightweight insulating concrete; and (b) a plurality of openings therethrough for the passage of moisture; applying a second layer of lightweight insulating concrete over said insulating layer.

17. The method of claim 16 wherein said recesses are substantially conical in shape.

18. The method of claim 16 wherein said recesses have a largest cross-wise dimension not greater than one-half inch.

19. A method of constructing a ventilated, insulated roof comprising the steps of:

providing a plurality of normally low-permeance insulation boards having upper and lower surfaces;

extending a plurality of recesses only partially therethrough at least one of said upper and lower surfaces of at least one of said insulation boards with protrusions from the curved surface of a cylinder;

applying a first layer of insulating concrete on a roof;

applying an insulating layer over said first layer from the plurality of insulation boards, at least one of said boards having a plurality of openings therethrough for the passage of moisture;

applying a second layer of insulating concrete over said insulating layer.

20. The method of claim 19 wherein said recesses are dimensioned so as to be substantially filled by said insulating concrete.

21. The method of claim 20 wherein said recesses have a largest cross-wise dimension not greater than one-half inch.

22. The method of claim 21 wherein at least some of said openings are of sufficient cross-wise dimension that concrete from said second layer of insulating concrete will flow into and substantially fill them and thus provide bridges of insulating concrete to be formed through said insulating board.

23. The method of claim 22 wherein at least some of said openings are of such dimension that passage of moisture is permitted yet substantial filling of the openings by fluid concrete placed thereon is prevented.

24. The method of claim 22 wherein at least one of said openings of sufficient cross-wise dimension is connected to an edge of said insulating board by a transverse slot formed through the insulating board and extending from the opening to the edge of the insulating board.

* * * * *